US006696625B2

(12) United States Patent
Sato

(10) Patent No.: US 6,696,625 B2
(45) Date of Patent: Feb. 24, 2004

(54) EASILY ADJUSTABLE ASSISTANT PEDAL SYSTEM FOR KEYBOARD MUSICAL INSTRUMENT

(75) Inventor: Toshifumi Sato, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/404,148

(22) Filed: Apr. 2, 2003

(65) Prior Publication Data

US 2003/0188621 A1 Oct. 9, 2003

(30) Foreign Application Priority Data

Apr. 4, 2002 (JP) ..... 2002-102383

(51) Int. Cl.[7] ..... G10C 3/26
(52) U.S. Cl. ..... 84/225
(58) Field of Search ..... 84/225, 226, 227, 84/228, 229, 230, 231, 232

(56) References Cited

U.S. PATENT DOCUMENTS 5,515,759 A * 5/1996 Geoghegan ..... 84/225
5,905,220 A * 5/1999 Lee et al. ..... 84/461
6,448,481 B2 * 9/2002 Maehara et al. ..... 84/225

FOREIGN PATENT DOCUMENTS

JP 59-158190 10/1984
JP 9-44145 2/1997

* cited by examiner

*Primary Examiner*—Kimberly Lockett
(74) *Attorney, Agent, or Firm*—Dickstein, Shapiro, Morin & Oshinsky, LLP.

(57) ABSTRACT

An assistant pedal system is used for assisting a child in playing a piano, and includes a frame structure, an assistant pedal mechanisms movably supported by the frame structure; the assistant pedal mechanism has assistant pedals on a plate serving as a foot rest, and pushers are provided for depressing pedals of the piano; the assistant pedals are connected through flexible cables to the pushers so that the flexible cables automatically change the routes between the assistant pedals and the pushers depending upon the distance between the frame structure and the assistant pedal mechanism; the flexible cables make the preparatory work before the performance easy.

16 Claims, 12 Drawing Sheets

EASILY ADJUSTABLE ASSISTANT PEDAL SYSTEM FOR KEYBOARD MUSICAL INSTRUMENT

FIELD OF THE INVENTION

This invention relates to an assistant pedal system and, more particularly, to an assistant pedal system which assists a child to selectively depress pedals of a keyboard musical instrument.

DESCRIPTION OF THE RELATED ART

Pieces of music are played on a keyboard musical instrument with thumbs, fingers and feet. The manufacturers design most of the keyboard musical instruments to be played by adults. However, parents want their children to take lessens on the keyboard musical instruments from an early age. Children's legs are so short that they feel it difficult to step on the pedals of the keyboard musical instrument. It is required to either buy a small-sized keyboard musical instrument or insert an assistant pedal system between children's feet and the pedals of the keyboard musical instrument. To buy the assistant pedal system is less expensive rather than to buy the small-sized keyboard musical instrument.

FIG. 1 shows a typical example of the assistant pedal system. In the following description, term "front" is indicative of a point closer to a keyboard musical instrument than a "rear" point. Term "fore-and-aft direction" is a virtual line connected between a front point and a corresponding rear point. Term "lateral" modifies a direction crossing the fore-and-aft direction at right angle on a virtual horizontal plane, and term "up-and-down" modify another direction normal to the virtual horizontal plane. In the prior art assistant pedal system 100 shown in FIG. 1, the terms "front" and "rear" are corresponding to the right side and left side, respectively.

The prior art assistant pedal system 100 largely comprises a stationary frame 100*a*, a movable assistant pedal mechanism 100*b*, a position adjuster 100*c*, a telescopic force transmission mechanism 100*d* and a coupling 100*e*. The stationary frame 100*a* is put on a floor, and the position adjuster 100*c* is connected at the lower end thereof to the stationary frame 100*a* and at the upper end thereof to the movable assistant pedal mechanism 100*b*. Thus, the movable assistant pedal mechanism 100*b* is spaced from the stationary frame 100*a* in the vertical direction by means of the position adjuster 100*c*. Since the position adjuster 100*c* is variable in the distance between the lower end and the upper end, the position adjuster 100*c* can vary the height of the assistant pedal mechanism 100*d* from the floor.

The telescopic force transmission mechanism 100*d* is connected at the upper end thereof to the assistant pedal mechanism 100*b* and at the lower end thereof to pedals 106 of a keyboard musical instrument such as a piano. The telescopic force transmission mechanism 100*d* is variable in distance between the upper end and the lower end. The coupling 100*e* is provided in association with the telescopic force transmission mechanism 100*b*, and fixes the telescopic force transmission mechanism to a given length.

When a user feels the assistant pedal mechanism 100*b* too low, the user lifts the assistant pedal mechanism 100*b*, and spaces the assistant pedal mechanism 100*b* from the stationary frame 100*a*. The distance between the pedals 106 and the assistant pedal mechanism is increased, and, accordingly, the telescopic force transmission mechanism 100*d* is elongated. On the other hand, when the user feels the assistant pedal mechanism 100*b* too high, the user pushes down the assistant pedal mechanism 100*b*, and the telescopic force transmission mechanism 100*d* is shrunk. When the user feels the assistant pedal mechanism 100*b* to be adjusted to the suitable position, the user fixes the telescopic force transmission mechanism 100*d* to the length by using the coupling 100*e*, and starts to perform a piece of music on the piano. Thus, the coupling 100*e* is required for the telescopic force transmission mechanism 100*b*.

The assistant pedal mechanism 100*b* includes assistant pedals 101, a bracket 102 and a foot rest 103. The bracket 102 projects from the front end of the foot rest 103, and the assistant pedals 101 rearward projects from the bracket 102. Although only one assistant pedal 101 is illustrated in FIG. 1, the other assistant pedals 101 hide themselves behind it. The assistant pedals 101 are swingably connected at the front ends thereof to the bracket 102, and a player selectively steps on the rear portions of the assistant pedals 101.

The stationary frame 100*a* is formed with a guide groove 100*h*, and the foot rest 103 is also formed with a guide groove (not shown). The position adjuster 100*c* includes a link work 105 and a manipulator (not shown). A user manipulates the manipulator for actuating the link work 105. The link work 105 has plural bars 105A and connectors 105B/105C. The plural bars 105A cross each other, and are connected at the intermediate portion by means of the connector 105B. The connector 105B permits the bars 105A to be rotated thereabout. The bars 105A are rotatably connected to at lower ends thereof to the stationary frame 100*a* and at the upper ends thereof to the foot rest 103 by means of the connectors 105C. The connectors 105C are slidably received in the guide grooves 100*h*, and the other connectors 105C are simply rotatably connected to the stationary frame 100*a* and foot rest 103. While the user is actuating the frame work 105 by means of the manipulator, the pins 105C slide in the guide grooves 100*h* in the fore-and-aft direction, and permit the bars 105A to change the relative position therebetween.

The telescopic force transmission mechanism 100*d* includes couplers 107, tubes 108*a*, rods 108*b* and coil springs 108*c*. The couplers 107 are respectively connected to the lower ends of the rods 108*b*, and the pedals 106 are coupled to the rods 108*b* by means of the couplers 107, respectively. On the other hand, the tubes 108*a* are connected at the upper ends thereof to the assistant pedals 101, and the rods 108*b* are slidable in the tubes 108*a* in the up-and-down direction. Although the tubes 108*a* and rods 108*b* are rigid, the total length of each tube 108*a* and the associated rod 108*b* is telescopically variable. The coil springs 108*c* are wound on the outer surfaces of the tubes 108*a*, and are secured to the tubes 108*a*, respectively so as to urge the associated tubes 108*a* and, accordingly, the assistant pedals 101 upwardly. The tubes 108*a* are secured to the associated rods 108*b* by means of the coupling 100*e* so that the force exerted on the assistant pedals 101 is transmitted through the tubes 108*a*, rods 108*b* and couplers 107 to the pedals 106 of the piano.

The coupler 100*e* includes supporting plates 109*a*/109*b* and long bolts 109*c*. The supporting plates 109*a*/109*b* are respectively fixed to the lower surface of the foot rest 103 and the tubes 108*a*, and are formed with the holes. The long bolts 109*c* passes through the holes, and are secured into the threaded holes formed in the tubes 108*a*. The tips of the long bolts 109*c* reach the rods 108*b*, and are pressed against the associated rods 108*b*. Thus, the tubes 108*a* are respectively coupled to the rods 108*b* by means of the long bolts 109*c*.

A child is assumed to practice the piano. The prior art assistant pedal system 100 is placed on the floor, and his or her parent loosens the long bolts 109*c*. The rods 108*b* are released from the associated tubes 108*a*, and become movable. The parent aligns the couplers 107 with the pedals 106 of the piano, and couples the rods 108*b* to the pedals 106 by means of the couplers 107. Subsequently, the parent actuates the link work 105 with the manipulator (not shown), and moves the assistant pedal mechanism 100*b* in the up-and-down direction. When the assistant pedals 101 are adjusted to the suitable positions for the child, the parent turns the long bolts 109*c*, and secures the rods 108*b* to the tubes 108*a*. Thus, the child gets ready for practicing a piece of music on the piano.

A problem is encountered in the prior art assistant pedal system in that the adjusting work is complicated and time consuming. As described hereinbefore, the user loosens the long bolts 109*c*, adjusts the assistant pedals 101 to the suitable positions, and secures the rods 108*b* to the tubes 108*a* by means of the long bolts 109*c*, again. The problem is serious in a concert where many children participate the concert program. Whenever the pianist is changed from a child to another child, an assistant readjusts the assistant pedals 101 to different positions suitable to the next child.

SUMMARY OF THE INVENTION

It is therefore an important object of the present invention to provide an assistant pedal system, which is easy to adjust assistant pedals to a pianist.

To accomplish the object, the present invention proposes to take up difference by changing a route along which a flexible force transmitter extends.

In accordance with one aspect of the present invention, there is provided a n assistant pedal system for transmitting a force to at least one pedal of a keyboard musical instrument comprising a foundation having a major surface, an assistant pedal mechanism having at least one assistant pedal moved between a rest position and an end position, a position adjuster connected at one end thereof to the foundation and at the other end thereof to the assistant pedal mechanism and actuated to vary a distance between the aforesaid one end and the other end, and a flexible force transmitter connected at one end thereof to the at least one assistant pedal, transmitting a force exerted on the assistant pedal to the aforesaid at lest one pedal of the keyboard musical instrument for moving the aforesaid at least one pedal from a rest position and automatically changing a route between the aforesaid at least one assistant pedal and the pedal depending upon the distance between the foundation and the assistant pedal mechanism.

BRIEF DESCRIPTION OF THE DRAWINGS

The features and advantages of the assistant pedal system will be more clearly understood from the following description taken in conjunction with the accompanying drawings, in which.

DESCRIPTION OF THE PREFERRED EMBODIMENTS

First Embodiment

System Configuration

Figure 1:
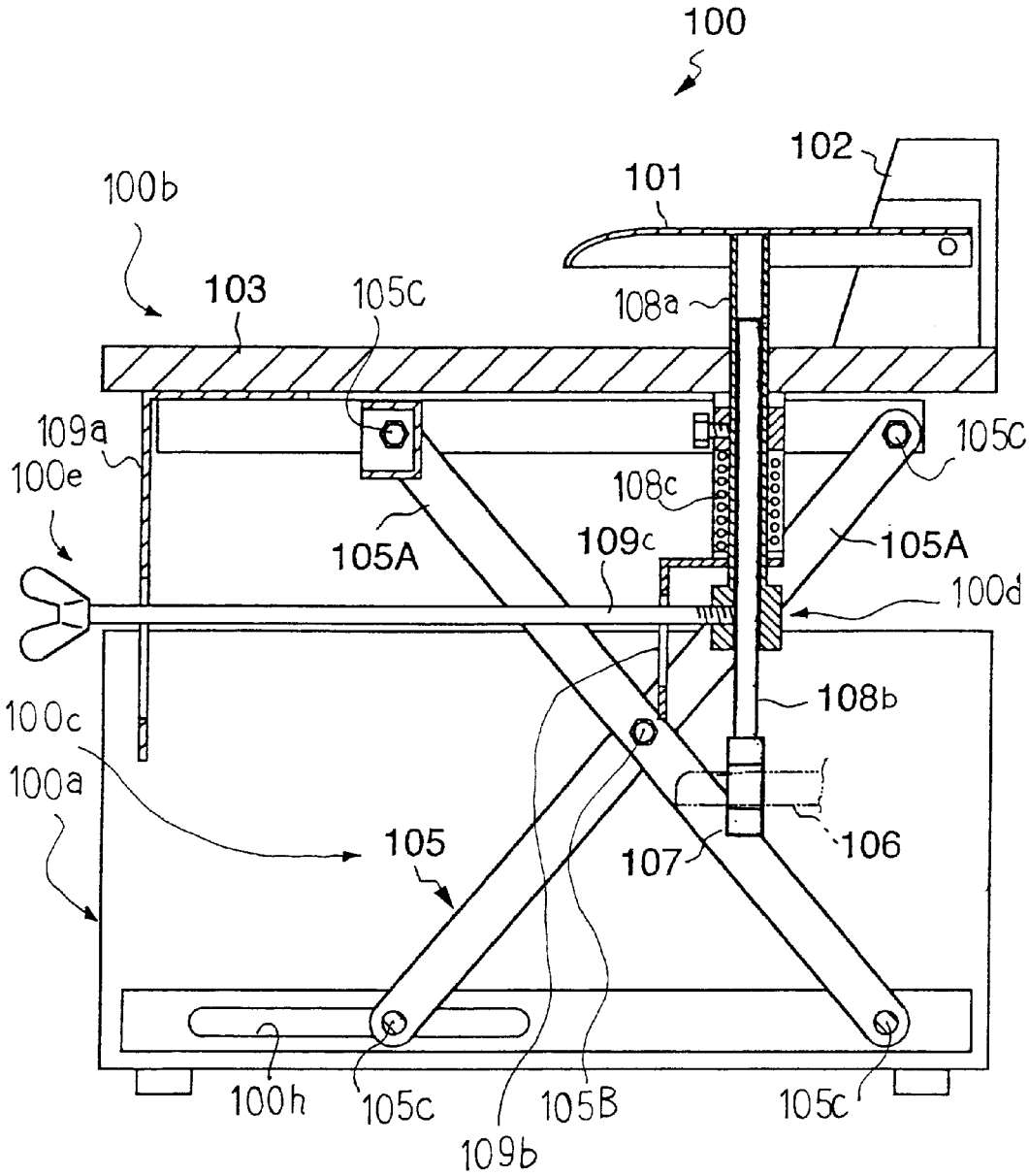
Fig. 1 PRIOR ART
FIG. 1 is a side view showing the structure of the prior art assistant pedal system.
Figure 2:
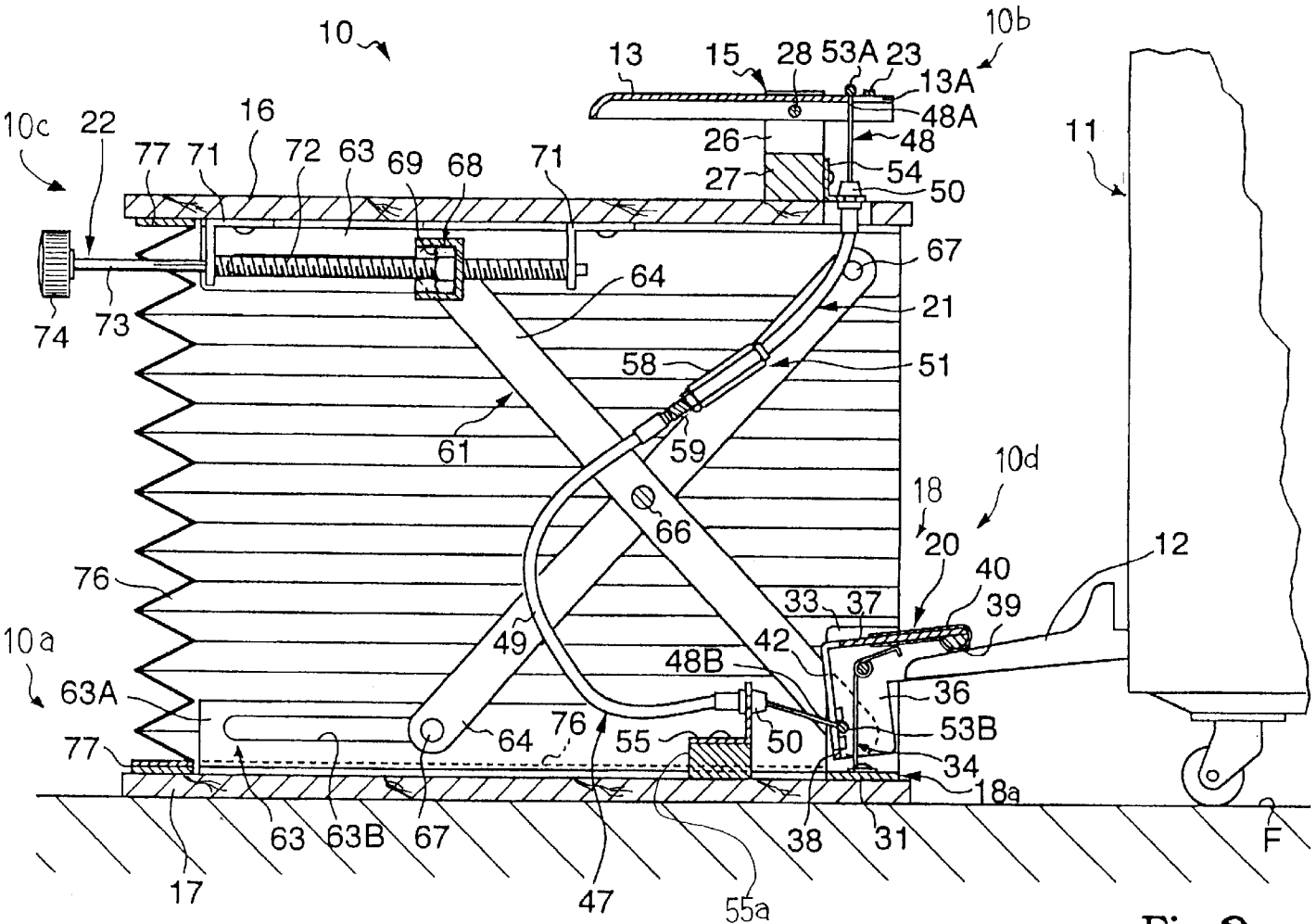
FIG. 2 is a cross sectional side view showing the structure of an assistant pedal system according to the present invention.

Referring first to FIG. 2 of the drawings, an assistant pedal system 10 embodying the present invention is designated in its entirety by reference numeral 10. In FIG. 2, term "front" and "rear" are corresponding to the right side and left side, respectively.

The assistant pedal system 10 largely comprises a stationary frame 10*a*, a movable assistant pedal mechanism 10*b*, a position adjuster 10*c* and a flexible force transmitter 10*d*. The stationary frame 10*a* is placed on a floor F in the vicinity of a keyboard musical instrument 11 such as, for example, a piano, and the movable assistant pedal mechanism 10*b* is provided over the stationary frame 10*a*. The position adjuster 10*c* is connected at the lower end thereof to the stationary frame 10*a* and at the upper end thereof to the movable assistant pedal mechanism 10*b*. A user manipulates the position adjuster 10*c* for varying the distance between the lower end and the upper end. The height of the assistant pedal mechanism 10*b* is increased together with the distance between the lower end and the upper end of the position adjuster 10*c*, and is decreased together with the distance. Thus, the user can adjust the assistant pedal mechanism 10*b* to a height suitable to a player by manipulating the position adjuster 10*c*.

The assistant pedal system 10 is equipped with the flexible force transmitter 10*d* instead of the force transmitting mechanism 100*d* and coupling 100*e* of the prior art assistant pedal system 100. The flexible force transmitter 10*d* is connected at one end thereof to the assistant pedal mechanism 10*b*, and depresses pedals 12 of the keyboard musical instrument 11 at the other end thereof. Thus, the flexible force transmitter 10*d* transmits the force exerted on the assistant pedal mechanism 10*b* to the pedals 12, and removes the force from the pedals 12.

The flexible force transmitter 10*b* is arbitrarily routed between the assistant pedal mechanism 10*b* and a certain region of the stationary frame 10*a* in the vicinity of the pedals 12. If the flexible force transmitter 10*b* straightly extends from the assistant pedal mechanism 10*b* and the certain region of the stationary frame 10*a*, the user can space the assistant pedal mechanism 10*b* from the stationary frame

10*a* as far as possible. If, on the other hand, the user makes the assistant pedal mechanism 10*b* closer to the stationary frame 10*a*, the flexible force transmitter 10*d* is warped so as to take up the difference between the distance and the length thereof. Thus, the flexible force transmitter 10*d* changes the route between the assistant pedal mechanism 10*b* and the stationary frame 10*a* without any assistance of the user.

When a child plays a piece of music on the keyboard musical instrument 11, an assistant puts the assistant pedal system 10 on the floor F, and aligns the flexible force transmitter 10*d* with the pedals 12. The assistant manipulates the position adjuster 10*c*, and varies the distance between the assistant pedal mechanism 10*b* and the stationary frame 10*a*. While the assistant is moving the assistant pedal system 10*b* in the up-and-down direction, the flexible force transmitter 10*d* automatically changes the route between the assistant pedal mechanism 10*b* and the certain region of the stationary frame 10*a*.

When the assistant finds the assistant pedal mechanism 10*b* suitable to the child, the assistant completes the preparatory work, and the child starts to perform a piece of music. Any coupler is not required for the flexible force transmitter 10*d*, because the flexible force transmitter 10*d* per se takes up the difference between the length thereof and the distance between the assistant pedal mechanism 10*b* and the stationary frame 10*a*. In other words, although the rigid tubes 108*a* and rigid rods 108*b* require the coupler 100*e* to take up the difference between the total length and the distance between the stationary frame 100*a* and the assistant pedal system 100*b*, the flexible force transmitter 10*d* makes the route equal in length thereto so that any coupler is not required. Thus, the assistant easily adjusts the assistant pedal system 10 to a player.

System Components

Figure 3:
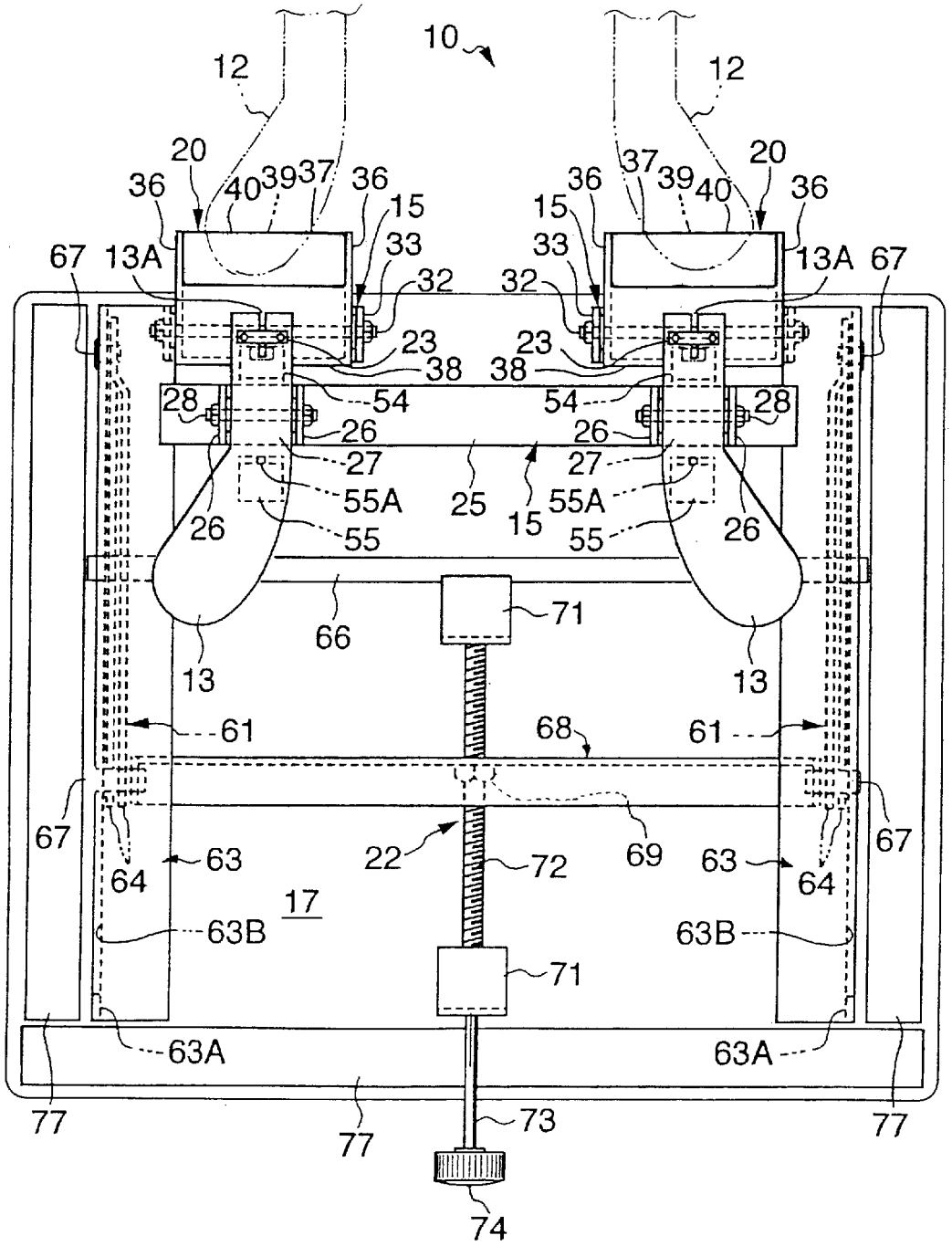
FIG. 3 is a plane view showing the structure of assistant pedals and structure of a position adjuster forming parts of the assistant pedal system.

Description is made on the stationary frame 10*a*, movable assistant pedal mechanism 10*b*, position adjuster 10*c* and flexible force transmitter 10*d* in more detail. Reference is made to FIG. 3 concurrently with FIG. 2. In FIG. 3, a foot rest 16, which forms a part of the assistant pedal mechanism, a bellows 76, which forms a part of the position adjuster 10*c*, and the flexible force transmitter 10*d* are removed from the assistant pedal system 10 so that the internal arrangement is seen.

Stationary Frame

The stationary frame 10*a* includes a base plate 17 and three dampers 77. The three dampers 77 are secured to the base plate 17, and the bellows 76 is anchored to the base plate 17 by means of the three dampers 77.

The base plate 17 has a rectangular top surface and a rectangular reverse surface. The rectangular reverse surface is to be held in contact with the floor F, and the three dampers 77 are arranged on the rectangular top surface. The base plate 17 has a front end line, a rear end line and side lines extending between the front end line and the rear end line. One of the dampers 77 extends along the rear end line, and is secured to the base plate 77. The other dampers 77 extend in parallel along the side lines, and are secured to the base plate 17. Thus, the three dampers 77 are arranged along the periphery of the base plate 17, and the bellows 76 are secured at the lower end to the base plate 17 by means of the three dampers 77. Thus, the stationary frame 10*a* not only supports the other system components 10*b*/10*c*/10*d* but also makes the bellows 76 anchored thereat.

Assistant Pedal Mechanism

The assistant pedal mechanism 10*b* includes the foot rest 16, three clampers 77, a frame work 15 and plural assistant pedals 13. The foot rest 16 is a plate corresponding to the base plate 17, and has a rectangular reverse surface and a rectangular top surface. The three dampers 77 are arranged on the rectangular reverse surface, and the frame work 15 and assistant pedals 13 are arranged on the top surface. One of the clampers 77 extends along the rear end of the rectangular top surface, and is secured to the foot rest 16. The other claimers 77 extend along the side lines in parallel, and are secured to the foot rest 16. The bellows 76 are connected at the upper end thereof to the rectangular reverse surface by means of the three dampers 77. Thus, the bellows 76 are connected between the rectangular top surface of the base plate 17 and the rectangular reverse surface of the foot rest 16, and is expanded and shrunk depending upon the position of the assistant pedal mechanism 10*b*.

The frame work 15 is provided in the front area of the rectangular top surface, and is secured to the foot rest 16. The assistant pedals 13 are swingably supported by the frame work 15, and is connected to the upper end of the flexible transmitter 10*d*. When a player steps on the assistant pedals 13, the force is exerted on the assistant pedals 13, and is transmitted from the assistant pedals 13 through the flexible force transmitter 10*d* to the pedals 12 of the keyboard musical instrument 11. The flexible force transmitter 10*d* exerts the force on the pedals 12, and the pedals 12 are depressed as if the player directly steps on the pedals 12.

The frame work 15 includes a lateral plate 25, pairs of side walls 26, pins 28 and blocks 27. The lateral plate 25 laterally extends on a narrow area parallel to the front end, and is secured to the foot rest 16. The pairs of side walls 26 are laterally spaced from one another, and are assigned to the assistant pedals 13, respectively. The side walls 26 of one pair upwardly project from the lateral plate 25, and are secured to the lateral plate 25 in such a manner that the side walls 26 are laterally spaced from each other by a distance slightly greater than the width of a boss portion of the associated assistant pedal 13. The side walls 26 of the other pair also upwardly project from the lateral plate 25, and are secured to the lateral plate 25 in such a manner that the side walls 26 are laterally spaced from each other by a distance slightly greater than the width of a boss portion of the associated assistant pedal 13. For this reason, the boss portions of the assistant pedals 13 are loosely inserted in the gaps between the associated pairs of side walls 26.

The pins 28 laterally extend between the side walls 26 of the associated pairs, and pass through the holes formed in the side walls 26 at both ends thereof. Both end portion of each pin 28 are threaded, and nuts are screwed into the threaded portions. The nuts are pressed against the side walls 26 so that the pins 28 are fixed to the pairs of side walls 26, respectively.

The assistant pedals 13 are turnably supported by the pins 28, respectively, and rearward project from the associated pairs of side walls 26. The pins 28 offer axes of rotation to the assistant pedals 13. The blocks 27 are provided in the gaps between the side walls 26 of the associated pairs, and are secured to the foot rest 16 under the assistant pedals 13. Each of the assistant pedals 13 is broken down into a foot portion and a connecting portion with respect to the associated pin 28. A player steps on the foot portion, and the connecting portion is bifurcated so as to form a slit 13A. The flexible force transmitter 10*d* is put into the slits 13A, and plate members 23 prohibit the flexible force transmitter 10*d* from dropping out from the slits 13A.

The assistant pedals 13 have contours like the contours of the pedals 12, respectively. The peripheries of the assistant pedals 13 are folded down for enhancing the rigidity against the bending moment. When a player steps on the foot portions of the assistant pedals 13, the assistant pedals 13 are driven for rotation about the axes of rotation, and actuate the flexible force transmitter 10*d*. While the player is practicing the fingering, the player rests his or her feet on the foot rest 16.

Position Adjuster

The position adjuster 10*c* includes an actuator 22, a pair of link work 61, two pairs of guide members 63 and the bellows 76. The bellows 76 have a contour like a channel, and are expansible and shrinkable. The bellows 76 are clamped at both ends thereof with the dampers 77, and define an inner space where the actuator 22, pair of link works 61 and pairs of guide members 63 are housed. However, the inner space is open to the outside on the front side. Thus, the bellows 76 hides the other components from user's views.

Each of the link work 61 has two pairs of nodes, which are respectively connected to the assistant pedal mechanism 10*c* directly and indirectly through the actuator and guide member 22/63 and stationary frame 10*a* directly and indirectly through the guide members 63. The actuator 22 gives rise to motion in the link works 61, and causes the link works 61 to change the distance between the pair of nodes connected to the assistant pedal mechanism 10*c* and the pair of nodes connected to the frame structure 10*a*. The guide members 63 take up the motion of the link works 61 in the fore-and-aft direction, and make the link works 61 smoothly increase and decrease the distance between the assistant pedal mechanism 10*b* and the stationary frame 10*b*. The guide members 63 and link works 61 will be hereinafter described in more detail.

One of the pairs of guide members 63 is provided on the rectangular top surface of the base plate 17, and the other pair of guide members is provided under the rectangular reverse surface of the foot rest 16. The guide members 63 of one pair are arranged in parallel to the side lines of the base plate 17 inside the dampers 77, and are secured to the base plate 17. Similarly, the guide members 63 of the other pair are arranged in parallel to the side lines of the foot rest 16 inside the dampers 77, and are secured to the foot rest 16. The guide members 63 are implemented by angle bars, and are formed with guide slots 63B. The guide members 63 have respective flat portions held in contact with the rectangular top surface of the base plate 17 and the rectangular reverse surface of the foot rest 16, and the walls portion 63A project from the flat portions. The guide slots 63B are respectively formed in the wall portions 63A, and extend in the fore-and-aft direction.

The actuator 22 includes a slider 68, a pair of short angle bars 71, a male screw 72, a connecting rod 73 and a knob 74. The short angle bars 71 are spaced from each other in the fore-and-aft direction, and are secured to the rectangular reverse surface of the foot rest 16. The short angle bars 71 are formed with through-holes, and the through-holes are aligned with each other. The connecting rod 73 is connected between the male screw 72 and the knob 74, and keeps the knob 74 outside the bellows 76. The male screw 72 passes through the through-holes of the short angle bars 71, and is rotatably supported by the short angle bars 71. A user turns the knob 74. Then, the moment is transmitted through the connecting rod 73 to the male screw 72. Thus, the user drives the male screw 72 for rotation by turning the knob 74.

The slider 68 is engaged with the guide slot, and is movable in the fore-and-aft direction under the guidance of the guide member 63. The slider 68 is connected at both side portions thereof to the link works 61 so that the slider 68 exerts force on both link works 61. The slider 68 has a nut 69, and the nut 69 is held in threaded engagement with the male screw 72. While the male screw 72 is being rotated, the nut 69 changes the rotation to linear motion, and exerts the force on the link works 61. Thus, the user actuates the link works 61 by means of the actuator 22.

The link works 61 are respectively associated with the guide members 63, and each of the link works 61 is implemented by a pair of plates 64. One of the plates 64 crosses the other plate 64 at the intermediate portions thereof, and the plates 64 are jointed at the intermediate portions by means of a pin 66. The pin 66 permits the plates 64 to relatively rotate with each other. Both ends of one plate 64 and both ends of the other plate 64 serve as the four nodes of the link work 61. One of the plates 64 obliquely extends from the front end of the base plate 17 to the rear portion of the foot rest 16, and is hereinbelow referred to as "first plate". The other of the plates 64 obliquely extends from the front end of the foot rest 16 to the rear portion of the base plate 17, and is referred to as "second plate". The first plate 64 is connected at the front end thereof to the wall portion 63A of the angle bar 63 secured to the base plate 17 by means of a pin 67 and at the rear end thereof to the slider 68 by means of a pin 67. The second plate 64 is connected at the front end thereof to the wall portion 63A of the angle bar 63 secured to the foot rest 16, and the rear end of the second plate 64 is engaged with the guide slot 63B by means of a slidable pin 67. The other link work 61 is similarly arranged, and is connected at the four nodes to the foot rest 16 and base plate 17 in a similar manner to the above-described link work 61.

Assuming now that a user wants to lower the assistant pedals 13, the user turns the knob 74 in a certain direction, and gives rise to the rotation of the male screw 72. The rotation is converted to the straight motion of the slider 68, and the slider 68 is moved rearward. The slider 68 exerts the force on the first plates 64, and gives rise to the moment in the counter clockwise direction on the first plates 64. The reaction from the guide member 63 gives rise to the moment in the clockwise direction on the second plates 64, and the pins 67 slide along the guide slots 63B rearward. As a result, the relative rotation takes place between the first plates 64 and the second plates 64, and the foot rest 16 is getting closer to the base plate 17. This results in that the assistant pedals 13 are lowered.

On the other hand, if the user wants to lift the assistant pedals 13, the user turns the knob 74 in the direction opposite to the certain direction, and gives rise to the rotation of the male screw 72. The rotation is also converted to the straight motion of the slider 68, and the slider 68 is moved frontward. The slider 68 exerts the force on the first plates 64, and gives rise to the moment in the clockwise direction on the first plates 64. The reaction from the guide member 63 gives rise to the moment in the counter clockwise direction on the second plates 64, and the pins 67 slide along the guide slots 63B frontward. As a result, the relative rotation takes place between the first plates 64 and the second plates 64, and the foot rest 16 is getting farther from the base plate 17. This results in that the assistant pedals 13 are lifted.

Flexible Force Transmitter

The flexible force transmitter 10*d* includes plural pushers 18, flexible connectors 21 and plural angle regulator 51. These component parts 18/21/51 are magnified in FIG. 4 so that description is made with reference to FIG. 4. The plural pushers 18 are provided on the base plate 17 in the vicinity of the pedals 12, and the flexible connectors 21 are connected at the upper ends thereof to the bifurcated portions of the assistant pedals 13 and at the lower ends to the associated pushers 18. A user is assumed to step on the assistant pedals 13. Then, the force is transmitted through the flexible connectors 21 to the pushers 18, and the pushers 18 independently depress the associated pedals 12.

Although the angle regulators 51 are inserted in the flexible force transmitting paths 21 in this instance, the angle regulators 51 may be deleted from the flexible force transmitter 10*d* in another instance. In other words, the angle regulators 51 are not indispensable elements of the flexible force transmitter 10*d*. The angle regulators 51 are used for changing the attitude of the pushers 20 as will be hereinlater described in detail.

The flexible connectors 21 are so flexible that the route between the assistant pedals 13 and the pushers 18 are varied depending upon the distance between the assistant pedals 13 and the pushers 18. This feature is desirable, because the flexible connectors 21 are automatically optimize the routes during the adjusting work on the assistant pedals 13. When the user lifts the assistant pedals 13, the flexible connectors 21 take up the slack, and changes the routes. The user is assumed to step on the assistant pedals 13. Then, the flexible connectors 21 transmit the force from the assistant pedals 13 to the associated pushers 18 along the new routes. On the other hand, when the user lowers the assistant pedals 13, the flexible connectors 21 are slackened, and change the routes. The force is transmitted from the assistant pedals 13 to the pushers 18 along the new routes. Thus, the use of the flexible connectors 21 makes the adjusting work on the assistant pedals 13 simple.

Figure 5:
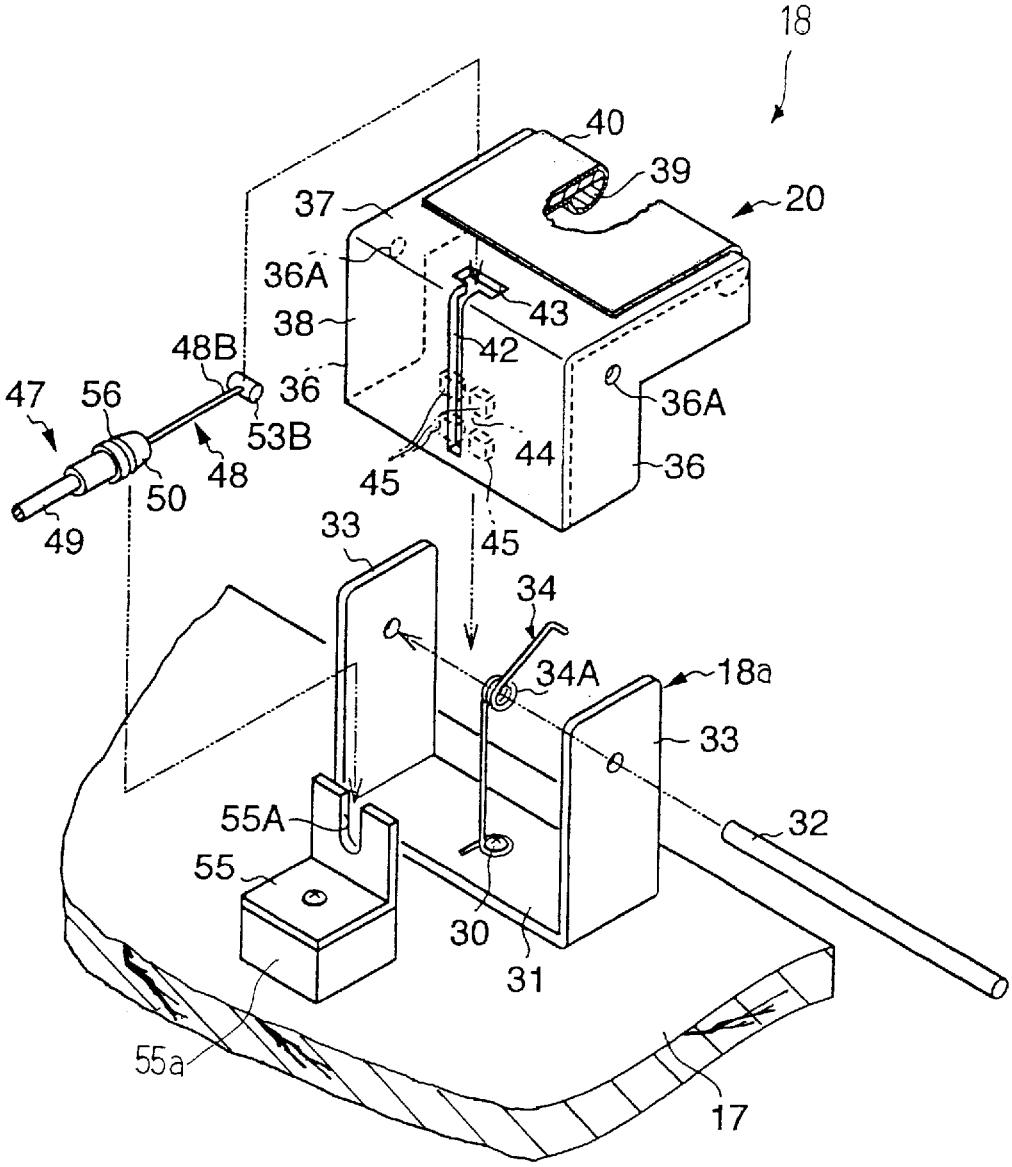
FIG. 5 is a fragmentary perspective view showing the structure of a pusher incorporated in the flexible force transmitter.

The pushers 18 are similar in structure to one another, and description is focused on one of the pushers 18 illustrated in FIG. 5. The pusher 18 is broken down into a supporting frame 18*a*, a rotatable block 20, a pin 32 and a return spring 34. The supporting frame 18*a* is secured to the base plate 17, and the rotatable block 20 is supported by the supporting frame 18*a* through the pin 32. The pin 32 offers an axis of rotation to the rotatable block 20. The rotatable block 20 is rotatable along a trajectory, and the associated pedal 12 projects into the trajectory. The return spring 34 is secured at one end thereof to the supporting frame 18*a*, and is held in contact at the other end thereof with the rotatable block 20. The return spring 34 always urges the rotatable block 20 in a direction to space the rotatable block 20 from the associated pedal 12. The flexible connector 21 is connected at one end thereof to the assistant pedal 13 and at the other end thereof to the rotatable block 20. When a user steps on the assistant pedal 13, the force is transmitted through the flexible connector 21 to the rotatable block 20, and gives rise to the rotation of the block 20 against the elastic force of the return spring 34. The rotatable block 20 is moved along the trajectory, and depresses the associated pedal 12. When the user removes the force from the associated assistant pedal 13, the return spring 34 spaces the rotatable block 20 from the associated pedal 12.

The supporting frame 18*a* has a bottom portion 31 and a pair of wall portions 33, and the wall portions 33 project from both sides of the bottom portion 31 in parallel to each other. Through-holes are formed in the wall portions 33, and are aligned with one another. The bottom portion 31 is secured to the front portion of the base plate 17. The return spring 34 has a spiral portion 34A, and is secured at the lower end portion thereof to the bottom portion 31 by means of a bolt 30. The return spring 34 is upright on the bottom portion 31, and the spiral portion 34A is aligned with the through-holes of the wall portions 33.

The pin 32 passes through the through-holes of the wall portions 33 and spiral portion 34A, and is secured to the wall portions 33. The rotatable block 20 is formed with through-holes 36A, and the rotatable block 20 is assembled with the supporting frame 18*a* in such a manner that the pin 32 passes the through-holes formed in the rotatable block 20. The upper end of the return spring 34 is held in contact with the rotatable block 20 so that the rotatable block 20 is urged to be spaced from the pedal 12 at all times. Nevertheless, the elastic force of the return spring 34 is not so large that the user could not feel the assistant pedal 13 heavy.

The rotatable block 20 has a contour like an inverted-L letter. The rotatable block 20 is partially cut away in FIG. 5. Comparing the rotatable block 20 shown in FIG. 5 with the rotatable block 20 shown in FIG. 3, the cut-away portion will be understood. The rotatable block has a pair of inverted-L shaped side portions 36, a top portion 37 and a rear portion 38. The inverted-L shaped side portions 36 are laterally spaced from each other, and the top portion 37 and rear portion 38 bridge the gap between the inverted-L shaped side portions 36.

The rotatable block 20 further has a semi-column member 39 and a cushion 40. The semi-column member 39 laterally extends along the front end line of the top portion 37, and is secured to the reverse surface of the top portion 37. Most of the upper surface of the top portion 37 is covered with the cushion 40. The cushion 40 is folded so that the semi-column member 39 and reverse surface of the top portion 37 are also covered with the cushion 40. The cushion 40 is made of left, cloth or leather, and takes up the impact against the associated pedal 12. The cushion 40 prevents the pedal 12 from damages and noise.

The rotatable block 20 is formed with a slit 42 and a slot 43, and two pairs of stoppers 45 are formed on the reverse surface of the rear portion 38. One of the pairs of stoppers 45 is spaced from the other pair of stoppers 45 along the slit 42, and the stoppers 45 are disposed on both sides of the slit 42 so as to form a narrow space between the pairs of stoppers 45. The slot 43 is much wider than the slit 42, and is formed in the top portion 37. The slit 42 extends from the wide slot 43 to a certain point in the rear portion 38. The flexible connector 21 has an end portion, which can passes through the wide slot 43. The end portion is received in the narrow space 44 so that the flexible connector 21 is engaged with the rotatable block 20.

The pin 32, which passes through the through-holes 36A and spiral portion 34A, laterally extends over the narrow space 44, and offers the axis of rotation to the rotatable block 20. When the flexible connector 21 rearward pulls the rear portion 38, the block 20 is rotated in the clockwise direction in FIG. 5 against the elastic force of the return spring 34, and exerts the force on the associated pedal 12. When the force is removed from the flexible connector 21, the return spring 34 gives rise to the rotation of the block 20 in the clockwise direction, and the pedal 12 and rotatable block 20 return to the respective rest positions.

Figure 4:
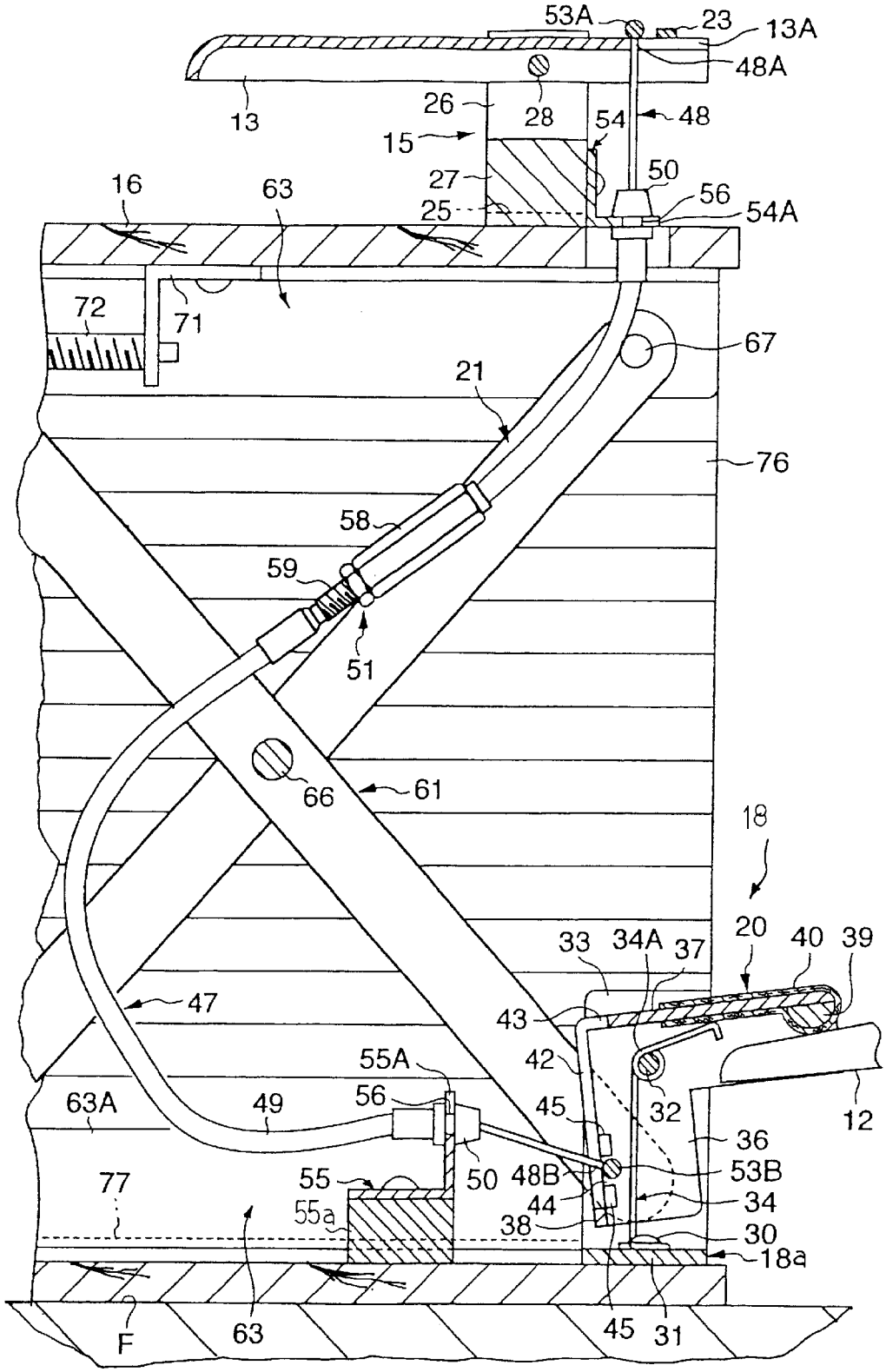
FIG. 4 is a cross sectional side view showing a flexible force transmitter incorporated in the assistant pedal system at a large magnification ratio.
Figure 6A:
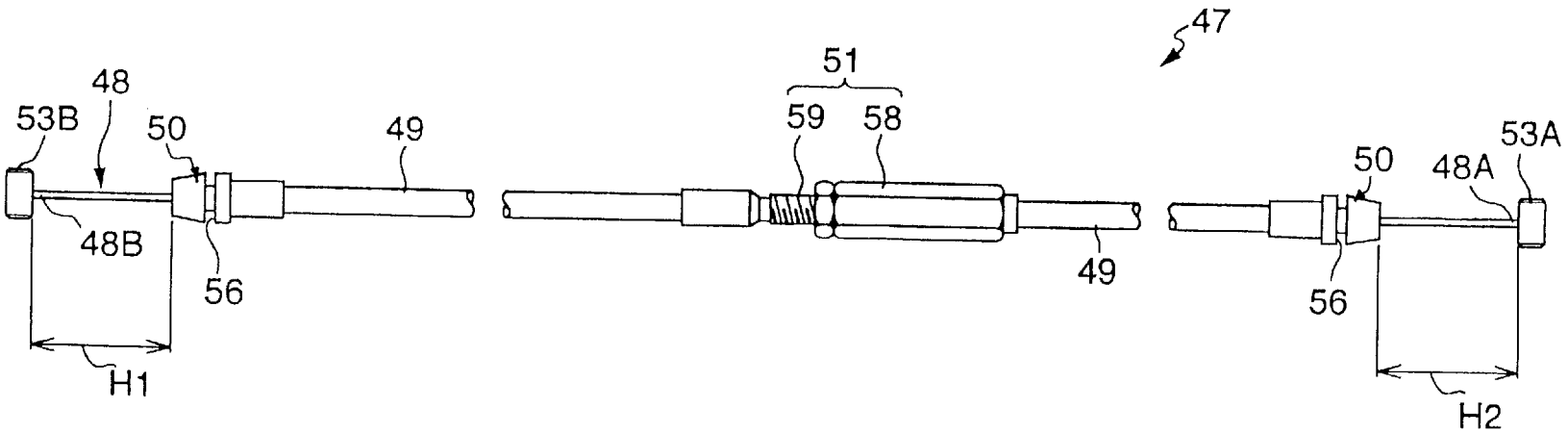
FIG. 6A is a plane view showing a flexible connector incorporated in the flexible force transmitter.
Figure 6B:
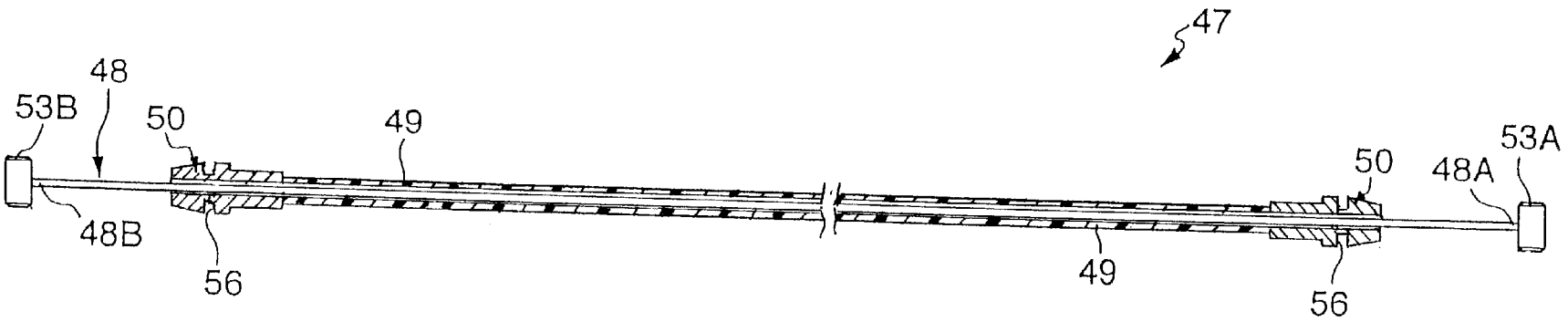
FIG. 6B is a cross sectional view showing the structure of the flexible connector.

The flexible connectors 21 are similar in structure to one another, and one of the flexible connectors 21 is described with concurrent reference to FIGS. 4, 6A and 6B. The flexible connector 21 includes a flexible cable 47, i.e., a flexible wire 48 inserted into a flexible tube 49, anchors 53A/53B fixed to both ends of the flexible wire 48 and fittings 54/55. The flexible tube 49 is divided into two parts, and the angle regulator 51 is connected between the two parts for changing the attitude of the associated pusher 20. The flexible wire 48 is slidable on the inner surface of the flexible tube 49. The flexible tube 49 and flexible tube 49 are so flexible that an assembling worker can arbitrarily route the flexible cable 47 in the space between the base plate 17 and the footrest 16. Nevertheless, the flexible tube 49 keeps itself along the route against the elasticity of the flexible wire 48. Even though the flexible wire 48 slides on the inner surface of the flexible tube 49 for exerting the force on the rotatable block 20, the flexible wire 48 does not change the flexible tube 49 from the present route to another route. A spiral wire may be wound on or embedded in a synthetic resin tube so as to impart the resistance against the elasticity to the flexible tube 49. However, while the assistance pedal mechanism 10*b* is moved from and/or toward the stationary frame 10*a*, the user does not feel the position adjuster 10*c* heavy.

The flexible tube 49 and angle regulator 51 are shorter than the flexible wire 48, and both end portions 48*a*/48*b* of the flexible wire 48 project from the flexible tube 49. The end portions 48*a*/48*b* measure H2 and HI. The anchors 53A/53B are short column pieces, and are fixed to the end portions 48A/48B in such a manner that the centerlines of the anchors 53A/53B cross the both end portions 48A/48B at right angle. The anchors 53A/53B side-ward project from the both end portions 48A/48B, respectively. The width of the slits 13A/42 is greater than the thickness of the flexible wire 48, and is less than the length of the centerlines of the anchors 53A/53B. However, the slot 43 is wider than the anchor 53B so that the anchor 53B can enter the space under the top portion 37 through the slot 43. After entry into the space under the top portion 37, the end portion 48B is moved into the slit 42, and the anchor 53B is put in the narrow space 44 between the pairs of stoppers 45. The pairs of stoppers 55 keep the anchor 53B in the narrow space 44. The anchor 53B is held in contact with the reverse surface of the rear portion 38, and makes the flexible cable 47 engaged with the rotatable block 20.

The end portion 48A is inserted into the slit 13A, and the anchor 53A is held in contact with the upper surface of the bifurcated portion of the associated assistant pedal 13. The short plate 23, which is secured to the bifurcated portion by means of the screws, prevents the end portion 48A from falling out from the bifurcated portion, and the anchor 53A can not pass through the slit 13A. For this reason, the flexible wire 48 is engaged with the bifurcated portion of the associated assistant pedal 13. The anchor 53A is only engaged with the bifurcated portion so that the assembling work is easy. Thus, the flexible wire 48 is connected at both ends thereof to the assistant pedal 13 and rotatable block 20, respectively.

The fittings 54/55 are implemented by short angle bars. The fitting 54 is held in contact with the front surface of the block 27, and is secured to the block 27 by means of screws. The other fitting 55 is held in contact with the upper surface of a block 55*a*, which is secured to the front area of the rectangular top surface of the base plate 17, and is secured to the block 55*a* by means of screws. Thus, the fittings 54/55 are respectively secured to the foot rest 16 and base plate 17 by means of the blocks 27/55*a*. The fitting 54 is moved together with the foot rest 16, and the other fitting 55 is stationary together with the base plate 17.

The fittings 54/55 are formed with slits 54A/55A, and frusto-conical fixtures 50 are secured to both ends of the flexible tube 49. Annular grooves 56 are formed in the frusto-conical fixtures 50, and the slits 54A/55A have the width roughly equal to the diameters in the annular grooves 56. The annular grooves 56 are aligned with the slits 54A/55A, and the frusto-conical fixtures 54/55 are pressed into the slits 54A/55A. Thus, the frusto-conical fixtures 50 are snugly received in the slits 54A/55A so that the flexible tube 49 is secured at both ends thereof to the foot rest 16 and base plate 17 by means of the fittings 54/55.

Thus, the flexible cable 47 is connected at both ends thereof to the assistant pedal mechanism 10*b* and the stationary frame 10*a*, and changes the routes depending upon the height of the assistant pedal mechanism 10*b* from the stationary frame 10*a*.

The angle regulators 51 are similar in structure to one another, and a user changes the attitude of the pusher 20 by manipulating the angle regulator 51. Each angle regulator 51 includes long/short tubular members 58 and a threaded rod 59. The threaded rod 59 is formed with a male screw, and is fixed to one of the two parts of the flexible tube 49. The short/long tubular members 58 are formed with female screws. The long tubular member 58 is fixed to the other of the two parts of the flexible tube 49, and the short tubular member, which is like a nut, is held in threaded engagement with the threaded rod 59. The flexible wire 58 passes through the two parts of the flexible tube 59, the short/long tubular members 58 and the threaded rod 59 so that the flexible wire 58 is a line.

If the rotatable block 20 is spaced from the associated pedal 12, the user loosens the short tubular member from the long tubular member, and screws the threaded rod 59 out of the long tubular member 48. Then, the total length of the flexible tube and slack corrector 49/51 is increased, and the length H1 is decreased. The flexible wire 48 pulls the rear portion 38 of the rotatable block 20, and the rotatable block 20 is inclined toward the pedal 12. Finally, the user tightens the short tubular member 58 to the long tubular member 58 so that the threaded rod 59 and long/short tubular members 58 keep themselves at the adjusted relative position.

If, on the other hand, the rotatable block 20 has been already pressed against the pedal 12, the user loosens the short tubular member 58 from the long tubular member 58, and screws the threaded rod 59 into the long tubular member 48. Then, the total length of the flexible tube and slack corrector 49/51 is decreased, and the both end portion 48B projects from the flexible tube 49. The flexible wire 48 permits the return spring 34 to upwardly push the rotatable block 20 so that the excess force is removed from the pedal 12. Finally, the user tightens the short tubular member 58 to the long tubular member 58 so that the threaded rod 59 and long/short tubular members 58 keep themselves at the adjusted relative position.

Behavior of Assistant Pedal System

A user sets the assistant pedal system 10 according to the present invention on the floor F for assisting a child in playing the keyboard musical instrument 11 as follows. The flexible connectors 21 are assumed to have been already connected between the assistant pedals 13 and the pushers 18. The anchors 53A were put on the bifurcated portions of the assistant pedals 13, and the plate members 23 were secured to the bifurcated portions. The flexible wires 48 downwardly projected through the slits 13A, and passed through the flexible tubes 49. The flexible tubes 48 passed through the slits 42, and the other anchors 53B were received in the narrow spaces 44 between the associated pairs of stoppers 45. The anchor 53B was only inserted into the space between the stoppers 45 so that the assembling work is simple and easy.

The user carries the assistant pedal system 10 to the keyboard musical instrument 11, and puts the assistant pedal system 10 on the floor F in such a manner that the rotatable blocks 20 are brought into the upper surfaces of the pedals 12. If the area in which the assistant pedal system 10 is put continues to the area in which a standard keyboard musical instrument 11 is put without any step, the rotatable blocks 20 are brought into contact with the pedals 12 without depressing the pedals. When the rotatable blocks 20 are brought into contact with the pedals 12 without depressing them, the assistant pedal system 10 gets ready for assisting the child in playing the keyboard musical instrument.

Figure 7:
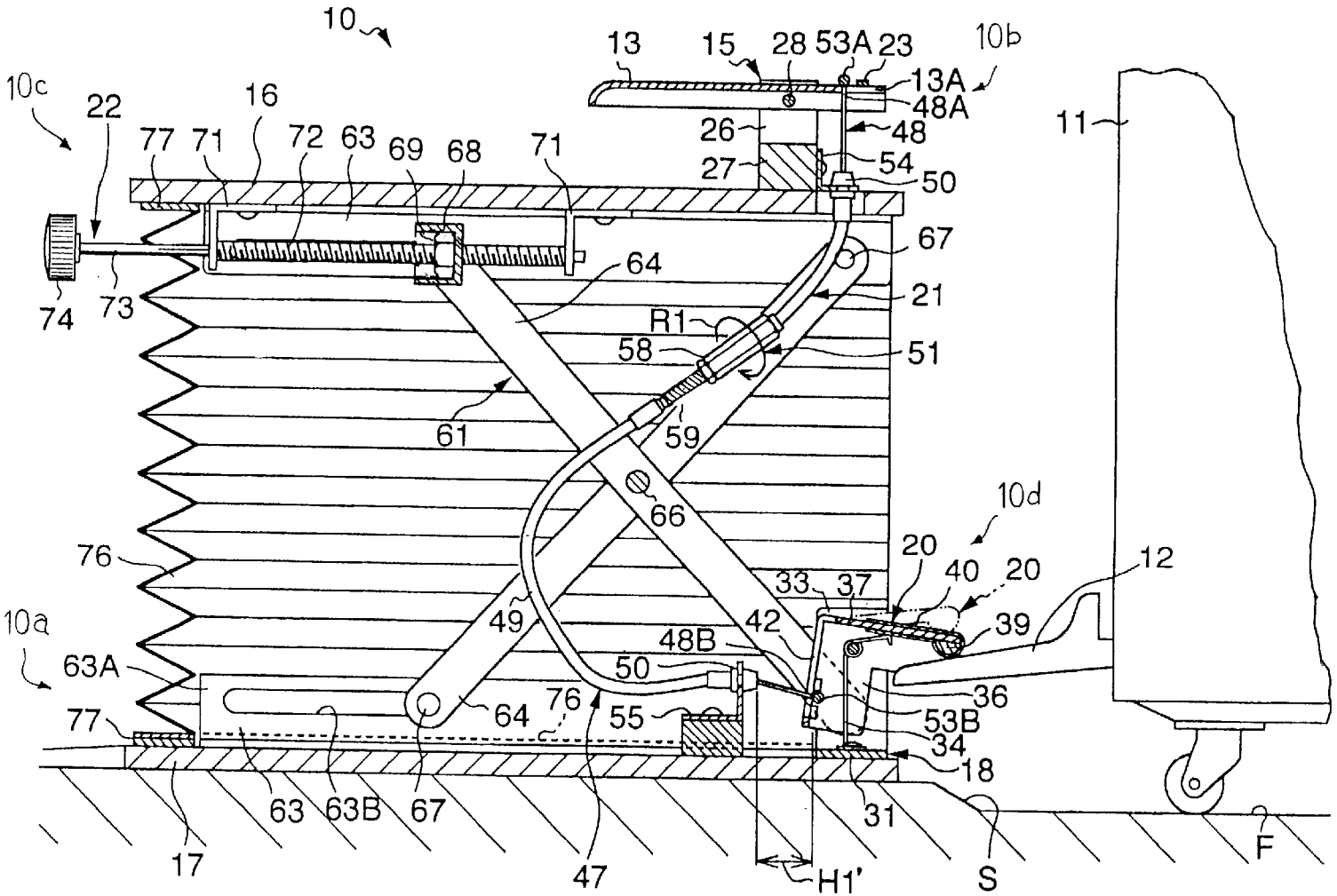
FIGS. 7 and 8 are cross sectional views showing regulation works on the assistant pedals and rotatable blocks.

The area assigned to the assistant pedal system 10 is assumed to be higher than the area assigned to the keyboard musical instrument 11 as shown in FIG. 7. The areas continue to each other through a step S. When the assistant pedal system 10 is put in the area at the back of the step S, the rotatable blocks 20 are spaced from the upper surfaces of the pedals 12 as shown in dots-and-dash lines in FIG. 7. The user loosens the short tubular member 58, and rotates the long tubular member 58 in a direction indicated by an arrow R1 for making the threaded rod 59 project therefrom. Then, the total length of the flexible tube/angle regulator 49/51 is increased, and the end portion 48*b* is retracted into the flexible tube 49. In other words, the length of the end portion 48*b* is decreased from H1 to H1', and the wire 48 pulls the rear portion 38 of the rotatable block 20. The wire 48 gives rise to rotation of the block 20 in the clockwise direction in FIG. 7, and the cushion 40 is brought into contact with the upper surface of the associated pedal 12. The angle regulator 51 gives rise to the rotation of the block 20, and the rotatable block 20 inclines toward the associated pedal 12. Thus, the user changes the attitude of the rotatable block 20 by manipulating the angle regulator 51. The user similarly brings the other rotatable block 20 into contact with the associated pedal 12 by manipulating the other angle changer 51, and the assistant pedal system 10 gets ready for assisting the child in playing on the keyboard musical instrument 11.

Figure 8:
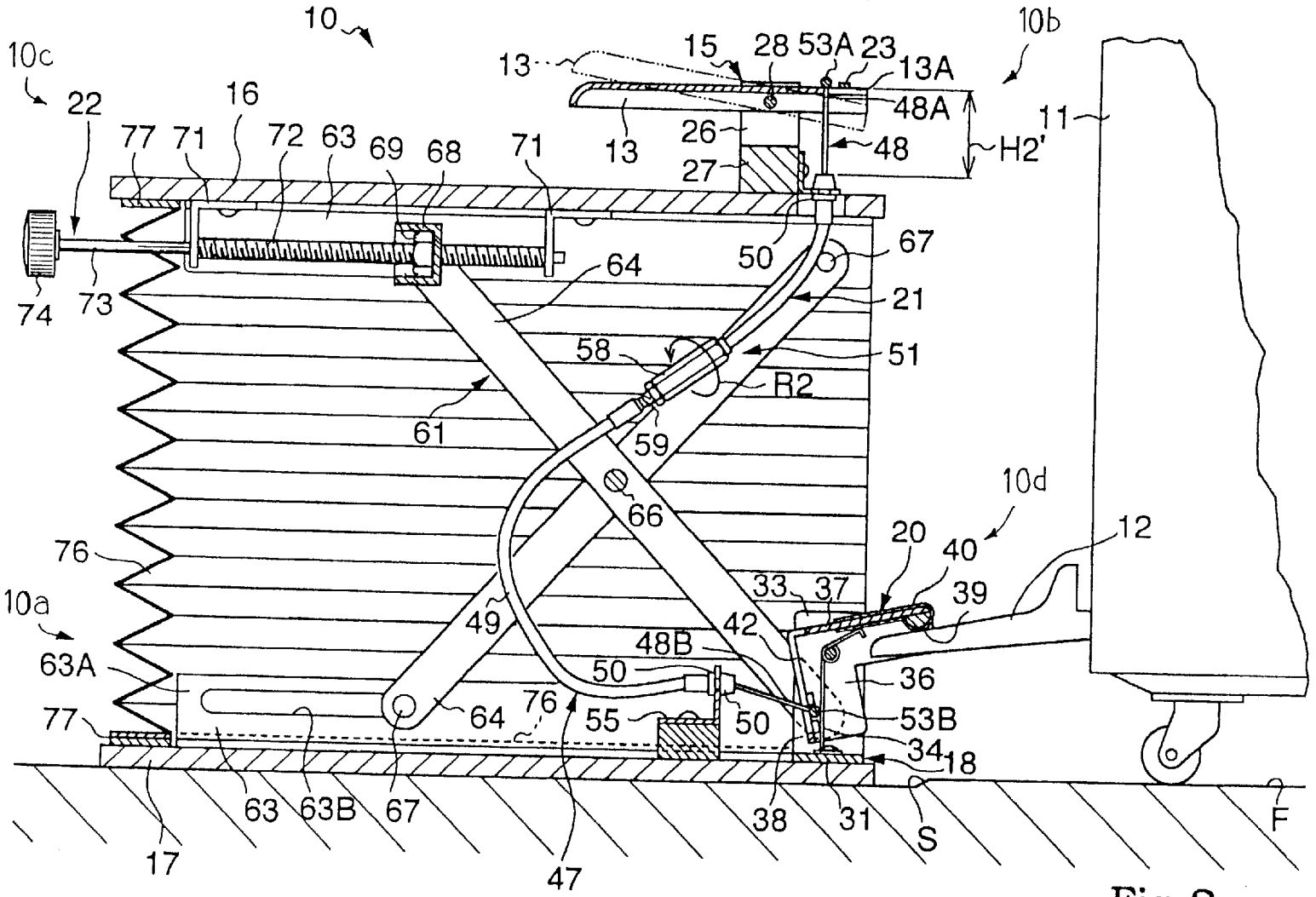

If, on the other hand, the area assigned to the assistant pedal system is lower than the area assigned to the keyboard musical instrument 11, the areas continue to each other through a step S as shown in FIG. 8. In this situation, when the user puts the assistant pedal system 10 in the area at the back of the step S, the rotatable blocks 20 are pressed against the associated pedals 12, and are rotated in the counter clockwise direction as shown in FIG. 8. The rotatable blocks 20 pulls the wires 48, and give rise to rotation of the assistant pedals 13 in the clockwise direction. This results in that the bifurcated portions of the assistant pedals 13 are pulled down as indicated by dots-and-dash lines in FIG. 8. The user loosens the short tubular members 58, and rotates the long tubular members 58 in the direction indicated by arrow R2 for retracting the threaded rods 59 into the long tubular members 58. This results in that the end portions 48A project from the flexible tubes 49. The length of the end portions 48A are increased from H2 to H2'. When the assistant pedals 13 become horizontal, the assistant pedal system 10 gets ready for assisting the child in playing the keyboard musical instrument.

Figure 9:
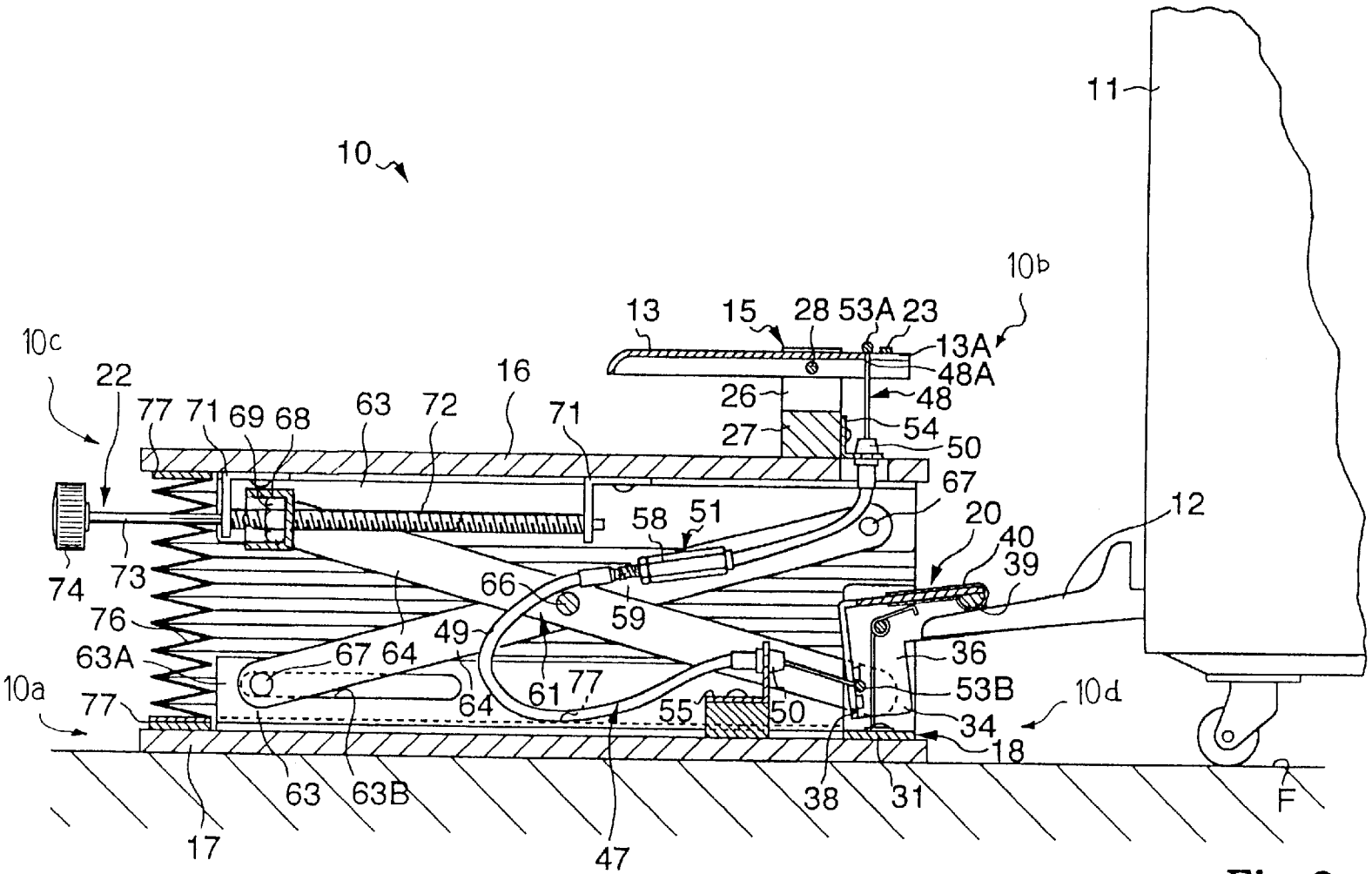
FIG. 9 is a cross sectional side view showing an adjustment work on an assistant pedal mechanism incorporated in the assistant pedal system.

The child is assumed to be tall. Although the pedals 12 are too low, the assistant pedals 13 are too high. Then, the user rotates the knob 74 in a direction to move the slider 68 rearward. Then, the pins 67 are moved along the guide slots 63B, and the first plates 64 and second plates 64 change the crossing angle. The link works 61 are crushed, and the assistant pedal mechanism 10*b* is lowered as shown in FIG. 9. The flexible connectors 21 automatically change the routes between the assistant pedals 13 and the pushers 18 without changing the total length thereof. Comparing FIG. 9 with FIG. 2, the change of the route is understood. This means that the user is not required for readjusting the attitude of the assistant pedals 13 and the attitude of the rotatable blocks 20. If the assistant pedals 13 become too low, the user rotates the knob 74 in the opposite direction. Then, the link works 61 lift the assistant pedal mechanism 10*b*. When the assistant pedals 13 are adjusted to the tall child, the tall child sits down on a stool (not shown), and starts to play a piece of music on the keyboard musical instrument.

The player is assumed to be changed from the tall child to a short child. The user rotates the knob 74 in the direction to move the slider 68 frontward. The pins 67 are also frontward moved along the guide grooves 63B, and the link works 61 are expanded in the up-and-down direction. The assistant pedal mechanism 10*b* is lifted from the position shown in FIG. 9. The flexible connectors 21 change the routes between the assistant pedals 13 and the rotatable blocks 20 without changing the length of the end portions 48A/48B so that the user is not required to readjust the attitudes of the assistant pedals/rotatable blocks 13/20. When the assistant pedals 13 are adjusted to the short child, the short child starts to perform a piece of music on the keyboard musical instrument 11.

Figure 10:
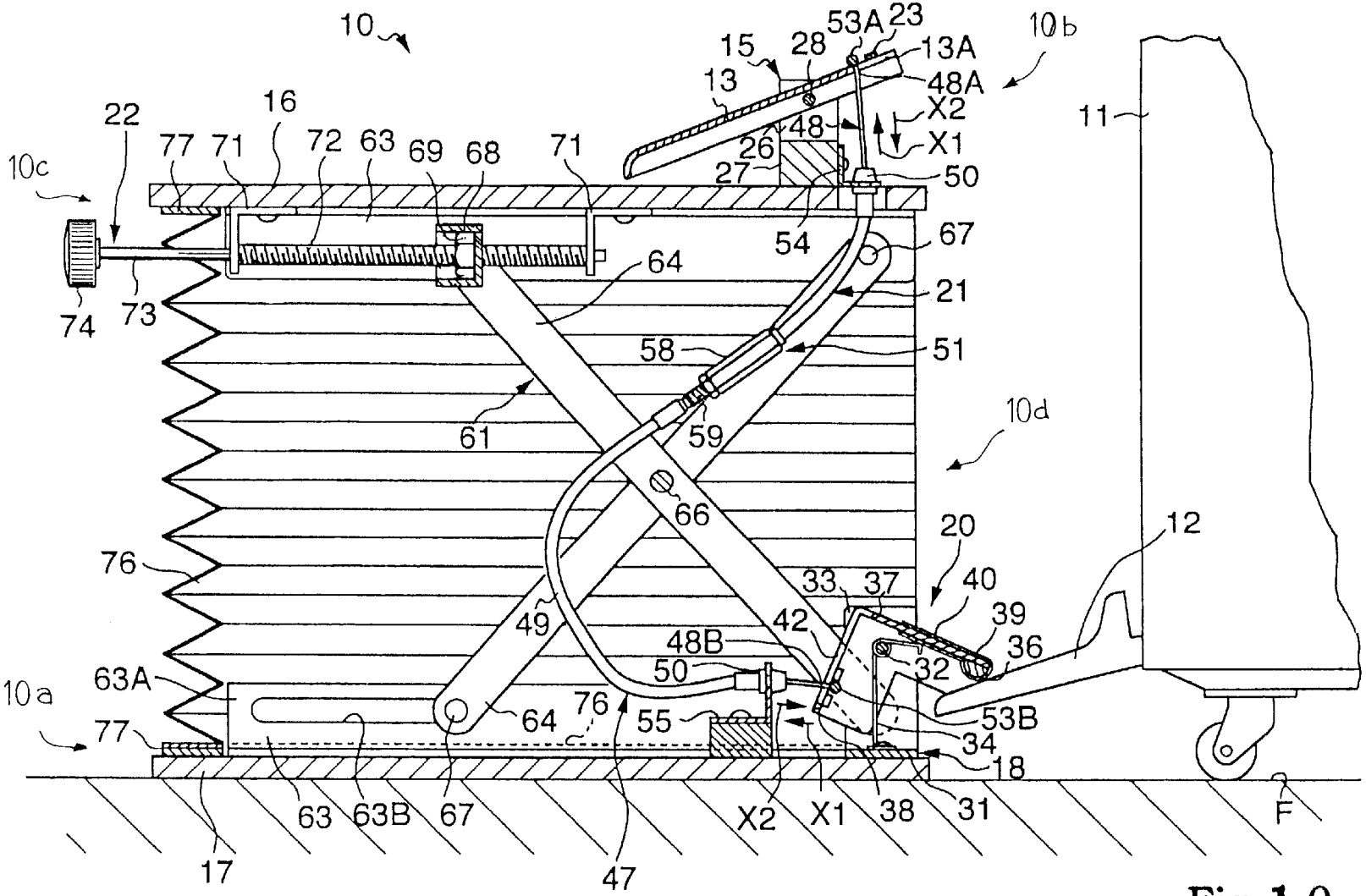
FIG. 10 is a cross sectional view showing a force transmission from the assistant pedal to the pedal of the keyboard musical instrument.

While the child is performing the piece of music on the keyboard musical instrument 11, he or she is assumed to step on one of the assistant pedals 13. The assistant pedal 13 is moved from a rest position, i.e., the horizontal position toward an end position, i.e., the inclined position shown in FIG. 10, and is rotated in the counter clockwise direction. The assistant pedal 13 pulls the wire 48 upwardly. The force is transmitted through the flexible connector 21, i.e., the flexible wire 48 to the rotatable block 20, and gives rise to the rotation in the clockwise direction. The rotatable block 20 inclines toward the pedal 12 against the elastic force of the return spring 34, and depresses the pedal 12. The pedal action is transmitted through a pedal mechanism (not shown) to a certain component member of the keyboard musical instrument 11, and an effect is imparted to the piano tone or tones.

When the child removes the force from the assistant pedal 13, the pedal 12 starts to return to the rest position, and the return spring 34 exerts the elastic force on the reverse surface of the top portion 37. Then, the block 20 is rotated in the counter clockwise direction, and pulls the wire 48. The force is transmitted to the bifurcated portion of the assistant pedal 13, and the bifurcated portion is pulled downwardly. The assistant pedal 13 is rotated in the clockwise direction, and returns to the horizontal position.

As will be understood from the foregoing description, a user adjust the assistant pedal mechanism 10*b* to a height suitable for a player by manipulating the position adjuster 10*c*, and the flexible force transmitter 10*d* automatically changes the route between the assistant pedal mechanism 10*b* and the pedals 12. This means that the user adjusts the assistant pedal system 10 to the player through the single manipulation on the position adjuster 10*c*. Even if the player is changed from a child to another child, the user promptly responds to the change of player.

Although the angle regulator 51 is not the indispensable element of the present invention, the user can change the attitudes of assistant pedals/rotatable blocks 13/20 by manipulating the angle regulator 51. Even if the step S takes place between the area assigned to the assistant pedal system 10 and the area assigned to the keyboard musical instrument 11, the user keeps the assistant pedals 13 and rotatable blocks 20 in the proper attitudes. If a keyboard musical instrument 11 has pedals 12 on a level different from those of another keyboard musical instrument 11, the assistant pedal system 10 is available for all of the keyboard musical instruments. Thus, the angle regulator 51 gives the universality to the assistant pedal system 10 according to the present invention.

Second Embodiment

Figure 11:
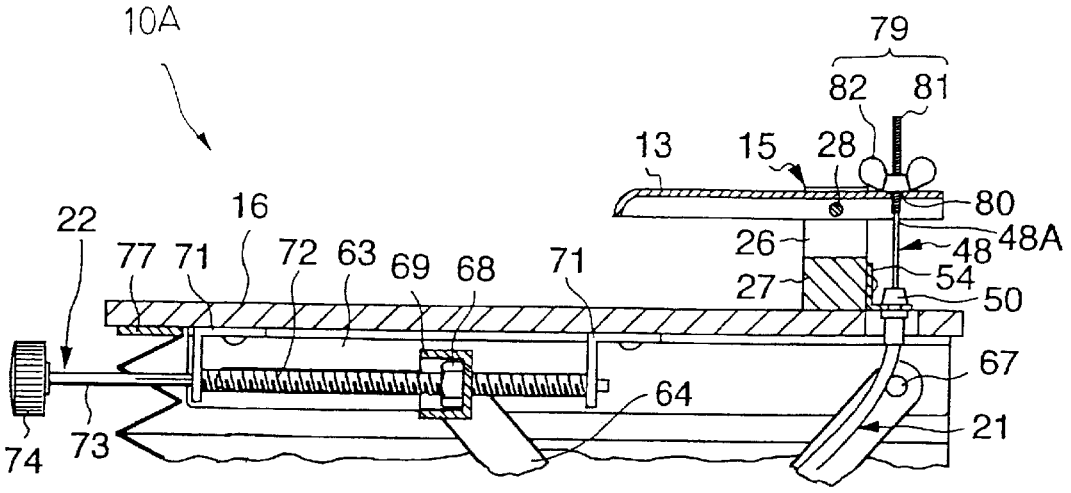
FIG. 11 is a cross sectional side view showing the structure of a part of another assistant pedal system according to the present invention.

FIG. 11 shows another assistant pedal system 10A embodying the present invention. The assistant pedal system 10A is similar to the assistant pedal system 10 except angle regulators 79. For this reason, description is focused on the angle regulators 79, and the other component parts are labeled with the references designating the corresponding component parts of the assistant pedal system 10 without detailed description.

Each of the angle regulators 51 and the associated anchor 53A are replaced with a threaded rod 81 and a wingnut 82, which form parts of the angle regulator 79. Accordingly, the slit 13A is replaced with a hole 80. The threaded rod 81 is fixed to the end portion 48A of the wire 48, and passes through the hole 80. The wingnut 82 is engaged with the threaded rod 81, and is pressed against the assistant pedal 13.

The rotatable blocks 20 are assumed to be spaced from the associated pedals 12 as similar to that indicated by the dots-and-dash lines in FIG. 7. The user tightens the wingnuts 82, and pulls the threaded rod 81 upwardly. Then, the angle regulator 79 decreases the total length of the wire 48 and the threaded rod 81 under the wing nut 82, and gives rise to the rotation of the block 20 in the clockwise direction. When the cushion 40 is brought into contact with the associated pedal 12, the user stops the turning motion on the wingnut 82.

If, on the other hand, the rotatable block 20 is pressed against the associated pedal 12, the assistant pedal 13 inclines as similar to that indicated by the dots-and-dash lines in FIG. 8, the user loosens the wingnut 82, and increases the total length of the wire 48 and threaded rod 82 under the wingnut 82. Then, the assistant pedal 13 is rotated in the counter clockwise direction, and returns to the horizontal position.

The flexible force transmitter incorporated in the second embodiment serves as that of the first embodiment, and achieves all the advantages. The angle regulators 79 also give the universality to the assistant pedal system 10A. The angle regulators 79 achieve another advantage. The angle regulators 79 are provided over the assistant pedals 13 so that the user easily manipulates the angle regulators 79. Thus, the easiness in the attitude regulation is the additional advantage achieved by the angle regulators 79.

Third Embodiment

Figure 12:
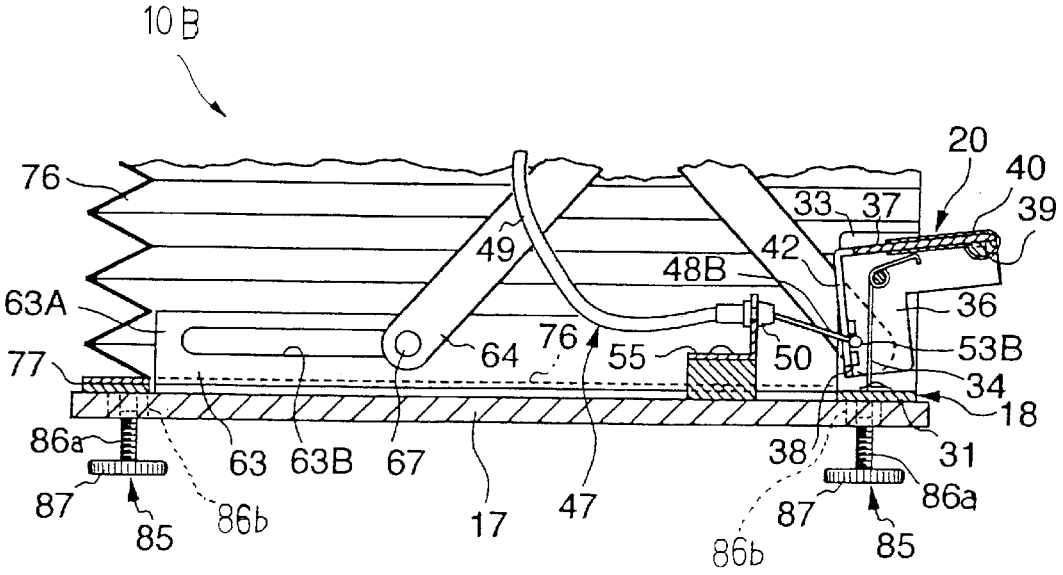
FIG. 12 is a cross sectional side view showing the structure of a part of yet another assistant pedal system according to the present invention.

FIG. 12 shows another assistant pedal system 10B embodying the present invention. The assistant pedal system 10B is similar to the assistant pedal system 10 except an angle regulator 85. For this reason, description is focused on the angle regulator 85, and the other component parts are labeled with the references designating the corresponding component parts of the assistant pedal system 10 without detailed description.

In the third embodiment, the angle regulators 51 are replaced with the angle regulator 85. The angle regulator 85 includes four adjusting screws 86*a* and four implanted nuts 86*b*. The implanted nuts 86*b* are embedded in the base plate 17 at the four corners, and the adjusting screws 86*a* are engaged with the associated nuts 86*b*. The adjusting screws 86*a* have respective discs 87 so that the total amount of contact area to the floor is increased.

If the assistant pedals 13 or rotatable blocks 20 are out of the proper attitude, the user tuns the adjusting screws 86*a* so as to change the gap between the floor and the reverse surface of the base plate 17. This results in the proper attitude of the assistant pedal/rotatable block 13/20.

Of course, the flexible force transmitter achieves all the advantages of the first embodiment, and the angle regulator 85 gives the universality to the assistant pedal system 10B.

Modifications

Although particular embodiments of the present invention have been shown and described, it will be apparent to those skilled in the art that various changes and modifications may be made without departing from the spirit and scope of the present invention.

First, the keyboard musical instrument may be another sort of acoustic keyboard such as an organ or a harpsichord, an electric keyboard or a composite keyboard musical instrument such as, for example, a silent piano or an automatic player piano. The keyboard musical instrument may be a keyboard for practical use, in which the strings are replaced with a pad and an electronic tone generating system. The piano does not set any limit to the technical scope of the present invention.

An assistant pedal system according to the present invention may have more than two assistant pedals 13. The number of assistant pedals is dependent on the pedals of a keyboard musical instrument. If the keyboard musical instrument has three pedals, then the assistant pedal system includes three assistant pedals and associated flexible force transmitters. In case where an assistant pedal system is designed for an electronic keyboard with more than three pedals, the assistant pedal system have the assistant pedals and associated flexible force transmitters equal in number to the pedals.

The base plate 17 does not set any limit on the technical scope of the present invention. Plural parts may be assembled into a frame structure, and disassembled to the plural parts, again. Pipes may be assembled into a stationary pipe structure.

The rectangular top surface does not set any limit on the technical scope of the present invention. The base plate may be disc-shaped or have a polygonal top surface or a triangle top surface.

The foot rest may be deleted from the assistant pedal mechanism 10*b*. In this instance, the assistant pedals 13 may be directly supported by the position adjuster.

The dampers 77 do not set any limit on the technical scope of the present invention. The bellows may be eliminated from the position adjuster. In this instance, the dampers 77 are useless. The bellows may be replaced with a sheet or sheets of curtain. In this instance, pinches or rails may be attached to the base plate or another sort of foundation.

The flexible cable 49 does not set any limit on the technical scope of the present invention. Any sort of flexible mechanical system, pneumatic system and hydraulic system are available for the assistant pedal systems according to the present invention. For example, zigzag link works are available for the assistant pedal systems. The air or gas may be confined in tubes for transmitting the force to plungers associated with the pedals of a keyboard musical instrument. Another sort of flexible mechanism is a string or belt given by a tension roller. The string or belt is connected between the assistant pedal and the pusher, and a tension roller is movably supported by the base plate. A spring always exerts the elastic force on the tension roller. If the assistant pedal mechanism is moved downwardly, the spring pulls the tension roller to prevent the string/belt from slack. When the assistant pedal mechanism is moved upwardly, the tension roller is moved in the opposite direction against the elastic force of the spring, and keeps the string or belt tensioned. Thus, the string or belt automatically changes the route depending upon the distance between the assistant pedal mechanism and the stationary frame.

The actuator 22 does not set any limit on the technical scope of the present invention. A gas spring system, an electric motor or a solenoid-operated actuator may be used for driving the link works 61.

The link works 61 do not set any limit on the technical scope of the present invention. Any sort of expandable/shrinkable link works is available for the position adjuster 10*c*. For example, a thick rotatable bolt is upright on the base plate 17, and a large nut is engaged with the thick rotatable bolt for moving the assistant pedal mechanism 10*b* in the up-and-down direction during the rotation of the thick bolt.

The pushers 18 do not set any limit on the technical scope of the present invention. The flexible force transmitter may be connected to the pedals of a keyboard musical instrument for pulling down the pedals.

The angle regulators 51/79/85 do not set any limit on the technical scope of the present invention. If the angle bars 54/55 are slidable on the blocks, the end portions 48A/48B have variable length.

The assistant pedals may be provided under the pedals 12.

Relation between Embodiments and Claims

The component parts are correlated with elements of claims as follows. In the first to third embodiments, the base plate 17 and dampers 77 as a whole constitute a foundation. However, the single board, frame or assemblage of plural parts may serve as the foundation as described in conjunction with the modifications. The major surface is corresponding to the rectangular top surface of the base plate 17. However, the major surface may have another shape as described in the sub-title of "modifications".

The flexible force transmitter 21 is an example. A pneumatic system, a hydraulic system and the combination of string/belt, tension roller and spring are other examples of the flexible force transmitter. The pusher 18 is an example of the actuator. However, another example of the actuator is a coupler connected between the flexible connector and the pedal 12 for pulling the pedal 12.

The link works 61 and guide members 63 and pins 67 as a whole constitute a link mechanism. Another example of the link mechanism is a zigzag link. The short angles 71, threaded rod 72, slider 68, nut 69, connecting rod 73 and knob 74 as a whole constitute an actuator connected to the link mechanism. Other examples of the actuator are a gas-spring system, a solenoid-operated actuator and a combination of an electric motor and rotation-to-straight motion converter such as a threaded rod and a nut.

The angle regulators 51, 79 and 85 are examples of a regulator for changing the relative relation between the flexible force transmitter and the pedal of the keyboard musical instrument. Since the pusher 18 has the rotatable block, the regulator is implemented by the angle regulator. However, if a coupler is used for pulling the pedal, the regulator may change the relative position between the flexible force transmitter and the pedal.

What is claimed is:

1. An assistant pedal system for transmitting a force to at least one pedal of a keyboard musical instrument, comprising:

a foundation having a major surface;

an assistant pedal mechanism having at least one assistant pedal moved between a rest position and an end position;

a position adjuster connected at one end thereof to said foundation and at the other end thereof to said assistant pedal mechanism, and actuated to vary a distance between said one end and said other end; and a flexible force transmitter connected at one end thereof to said at least one assistant pedal, transmitting a force exerted on said at least one assistant pedal to said at least one pedal of said keyboard musical instrument for moving said at least one pedal from a rest position, and automatically changing a route thereof between said at least one assistant pedal and said at least one pedal depending upon the distance between said foundation and said assistant pedal mechanism.

2. The assistant pedal system as set forth in claim 1, in which said keyboard musical instrument has another pedal, and said assistant pedal mechanism further has another assistant pedal connected to one end of another flexible force transmitter similar in structure and function to said flexible force transmitter so that a force exerted on said another assistant pedal is transmitted through said another flexible force transmitter to said another pedal.

3. The assistant pedal system as set forth in claim 1, in which said flexible force transmitter includes a flexible connector connected at one end thereof to said at least one assistant pedal and automatically changing said route between said at least one assistant pedal and said at least one pedal depending upon the distance between said foundation and said assistant pedal mechanism, and an actuator supported by said foundation and connected to the other end of said flexible connector for moving said at least one pedal.

4. The assistant pedal system as set forth in claim 3, in which said flexible connector has a flexible tube connected at one end thereof to said assistant pedal mechanism and at the other end thereof to said foundation, and a flexible wire passing through said flexible tube and connected at one end thereof to said at least one assistant pedal and at the other end to said actuator.

5. The assistant pedal system as set forth in claim 3, in which said actuator has a supporting member secured to said foundation, a block rotatably supported by said supporting member and having a trajectory partially merged with a trajectory of said at least one pedal for depressing said at least one pedal, and a spring urging said block in a direction to space said block from said at least one pedal.

6. The assistant pedal system as set forth in claim 1, in which said position adjuster includes a link mechanism connected at one end thereof to said assistant pedal mechanism and at the other end thereof to said foundation, expandable and shrinkable for changing the distance between said one end and said other end, and an actuator connected to said link mechanism for expanding and shrinking said link mechanism.

7. The assistant pedal system as set forth in claim 1, in which said assistant pedal system further includes a foot rest connected to said other end of said position adjuster, and a frame supported by said foot rest and movably supporting said at least one assistant pedal.

8. The assistant pedal system as set forth in claim 1, further comprising a regulator for changing a relative relation between said force transmitter and said at least one pedal.

9. The assistant pedal system as set forth in claim 8, in which said regulator varies a force exerted by said flexible force transmitter on said at least one pedal through changing said relative relation.

10. The assistant pedal system as set forth in claim 9, in which said flexible force transmitter includes an actuator exerting said force on said at least one pedal and a flexible connector connected at one end thereof to said at least one assistant pedal, transmitting said force exerted on said at least one assistant pedal to said actuator and automatically changing a route thereof between said at least one assistant pedal and said at least one pedal depending upon the distance between said foundation and said assistant pedal mechanism, and said regulator changes an attitude of said actuator for varying said force.

11. The assistant pedal system as set forth in claim 10, in which said flexible connector includes a flexible tube connected at one end thereof to said assistant pedal mechanism and at the other end thereof to said foundation and a flexible wire passing through said flexible tube and connected at one end thereof to said at least one assistant pedal and at the other end to said actuator, and said regulator changes said attitude by varying a difference in length between said flexible tube and said flexible wire.

12. The assistant pedal system as set forth in claim 11, in which said regulator varies the length of said flexible tube.

13. The assistant pedal system as set forth in claim 12, in which said flexible tube is divided into two parts, and said regulator has a rod formed with a male screw, connected to one of said two parts and permitting said flexible wire to pass therethrough and a tubular member formed with a female screw engaged with said male screw, connected to the other of said two parts and permitting said flexible wire to pass therethrough.

14. The assistant pedal system as set forth in claim 11, in which said regulator varies the length of said flexible wire measured between said at least one assistant pedal and said actuator.

15. The assistant pedal system as set forth in claim 14, in which said regulator has a rod formed with a male screw, connected to said one end of said flexible wire and passing through a hole formed in said at least one assistant pedal and a nut formed with a female screw engaged with said male screw and held in contact with an upper surface of said at least one assistant pedal.

16. The assistant pedal system as set forth in claim 10, in which said regulator has nuts secured to said foundation and adjusting screws respectively engaged with said nuts and manipulated by a user for changing a relative position between said actuator and said at least one pedal.

* * * * *